US009835171B2

(12) United States Patent
Kimmel et al.

(10) Patent No.: US 9,835,171 B2
(45) Date of Patent: Dec. 5, 2017

(54) VANE CARRIER ASSEMBLY

(75) Inventors: Keith D. Kimmel, Campbell, CA (US); Jack Wilson, Palm Beach Gardens, FL (US)

(73) Assignee: Siemens Energy, Inc., Orlando, FL (US)

( * ) Notice: Subject to any disclaimer, the term of this patent is extended or adjusted under 35 U.S.C. 154(b) by 1464 days.

(21) Appl. No.: 12/859,904

(22) Filed: Aug. 20, 2010

(65) Prior Publication Data

US 2012/0045312 A1 Feb. 23, 2012

(51) Int. Cl.

| | |
|---|---|
| ***F01D 9/04*** | (2006.01) |
| ***F01D 25/26*** | (2006.01) |
| ***F04D 29/54*** | (2006.01) |
| ***F01D 11/18*** | (2006.01) |
| ***F01D 25/24*** | (2006.01) |

(52) U.S. Cl.

CPC ..... *F04D 29/541* (2013.01); *F01D 9/041* (2013.01); *F01D 11/18* (2013.01); *F01D 25/246* (2013.01); *F01D 25/26* (2013.01); *F04D 29/542* (2013.01)

(58) Field of Classification Search

CPC ..... F04D 29/542; F04D 29/541; F04D 29/54; F01D 25/246; F01D 25/26; F01D 11/18; F01D 9/041; F01D 9/04

USPC ..... 415/139, 136, 134, 189, 190

See application file for complete search history.

(56) References Cited

U.S. PATENT DOCUMENTS

| | | | | |
|---|---|---|---|---|
| 3,302,926 | A * | 2/1967 | Bobo | 415/209.2 |
| 3,779,665 | A | 12/1973 | Tatem, Jr. et al. | |
| 3,892,497 | A * | 7/1975 | Gunderlock et al. | 415/134 |
| 4,247,247 | A | 1/1981 | Thebert | |
| 4,522,559 | A * | 6/1985 | Burge et al. | 415/196 |
| 5,295,787 | A * | 3/1994 | Leonard et al. | 415/173.3 |
| 5,354,174 | A * | 10/1994 | Balkcum et al. | 415/209.2 |
| 6,142,731 | A * | 11/2000 | Dewis et al. | 415/136 |
| 6,488,470 | B1 | 12/2002 | Owczarek | |
| 7,210,899 | B2 * | 5/2007 | Wilson, Jr | 415/173.1 |
| 7,434,402 | B2 | 10/2008 | Paprotna et al. | |
| 7,604,455 | B2 | 10/2009 | Paprotna et al. | |
| 2002/0094268 | A1 * | 7/2002 | Sugishita et al. | 415/139 |
| 2004/0240986 | A1 * | 12/2004 | Burdgick | 415/139 |
| 2005/0058537 | A1 * | 3/2005 | Corman et al. | 415/139 |
| 2005/0173871 | A1 * | 8/2005 | Paprotna et al. | 277/630 |
| 2006/0225430 | A1 | 10/2006 | Paprotna et al. | |

(Continued)

OTHER PUBLICATIONS

Incoloy alloy 909. Datasheet [online]. Special Metals, Sep. 4 [retrieved on May 1, 2013]. Retrieved from the Internet: <URL: http://www.specialmetals.com/documents/Incoloy%20alloy %20909.pdf>.*

*Primary Examiner* — Dwayne J White
*Assistant Examiner* — Joshua R Beebe

(57) ABSTRACT

A vane carrier assembly is provided for supporting vanes within a main engine casing of a gas turbine engine. The vane carrier assembly comprises a plurality of vane support panels positioned adjacent to one another so as to define a vane support assembly. The support panels are assembled such that the support panels expand circumferentially to minimize radial expansion of the vane support assembly during operation of the gas turbine engine. A control ring is coupled to the main engine casing, and the vane support assembly is coupled to the control ring. The control ring may be formed from a material having a coefficient of thermal expansion less than that of the material from which the vane support assembly is formed.

16 Claims, 6 Drawing Sheets

(56) References Cited

U.S. PATENT DOCUMENTS

| | | | | |
|---|---|---|---|---|
| 2008/0131270 | A1 | 6/2008 | Paprotna et al. | |
| 2009/0047126 | A1 | 2/2009 | Ress, Jr. | |
| 2010/0031671 | A1* | 2/2010 | Chehab et al. | 60/796 |

* cited by examiner

VANE CARRIER ASSEMBLY

FIELD OF THE INVENTION

The invention relates in general to gas turbine engines and, more specifically, to a vane carrier assembly for use in a gas turbine engine.

BACKGROUND OF THE INVENTION

A conventional combustible gas turbine engine includes a compressor, a combustor, and a gas turbine. The engine further comprises an outer casing which defines an outer section for each of the compressor, combustor and gas turbine. A rotor extends through the engine. The rotor portion extending through the compressor is defined by a plurality of discs. Each disc can host a row of rotating airfoils, commonly referred to as blades. The rows of blades alternate with rows of stationary airfoils or vanes. The vanes can be mounted to the casing via one or more vane carrier assemblies. A clearance is defined between tips of the blades and an inner surface of vane carrier support panels. During operation of the gas turbine engine, fluid leakage through this clearance contributes to system losses, decreasing the operational efficiency of the engine. It is desirable to keep the clearance as small as possible to increase engine performance. However, it is necessary to maintain a clearance between the rotating and stationary components to prevent rubbing between the rotating and stationary components, which can lead to component or engine damage.

The size of the clearance can change during engine operation due to differences in the thermal growth response times of the compressor moving parts and that of the stationary structure. For example, the thermal growth response time of the stationary structure (e.g., the vane carrier assembly to which the vanes are connected) is significantly quicker than that of the rotating structure (rotor). Thus, the stationary structure has a faster thermal response time and responds (through expansion or contraction) more quickly to a change in temperature than the rotating structure.

SUMMARY OF THE INVENTION

In accordance with a first aspect of the present invention, a vane carrier assembly is provided for supporting vanes within a main engine casing of a gas turbine engine. The vane carrier assembly may comprise a plurality of vane support panels positioned adjacent to one another so as to define a vane support assembly. The support panels may be assembled such that the support panels expand circumferentially to minimize radial expansion of the vane support assembly during operation of the gas turbine engine. The vane carrier assembly may also comprise a control ring coupled to the main engine casing. The vane support assembly is coupled to the control ring.

The control ring may be supported by the main engine casing such that the main engine casing is capable of moving radially relative to the control ring.

The plurality of vane support panels may be made from a first material and the control ring may be made from a second material. The second material may be thermally more stable than the first material.

The first material may have a coefficient of thermal expansion greater than that of the second material.

The first material may be formed from a steel alloy.

The second material may be formed from one of INCOLOY® Alloy 909 (a nickel-iron-cobalt alloy), INCOLOY® Alloy 939 (a nickel based alloy), or NILO® Alloy K (a nickel-iron-cobalt controlled-expansion alloy).

In accordance with one embodiment, each of the vane support panels may comprise a first section, to which vanes are coupled, and a second section. The panel second sections may be formed from a first material and the panel first sections and the control ring may be formed from a second material. The first material may have a coefficient of thermal expansion greater than that of the second material.

In accordance with another embodiment, the control ring may have a radial dimension which is greater than an axial dimension.

In accordance with a further embodiment, the control ring may have an axial dimension which is greater than a radial dimension.

Each of the vane support panels may extend generally circumferentially in response to thermal expansion and contraction during operation of the gas turbine engine.

The control ring may be formed from a low thermal coefficient of expansion material to generally minimize thermal expansion and contraction of the control ring in a radial direction.

In accordance with a second aspect of the present invention, a method is provided for controlling clearance between tips of rotating blades and an inner surface of a vane support assembly within an engine casing of a gas turbine engine. The method may comprise providing a plurality of vane support panels positioned adjacent to one another to define the vane support assembly. The panels may be made of a first material. The method may further comprise providing a control ring adapted to be supported by the engine casing and made of a second material, and securing the vane support assembly to the control ring. The second material is thermally more stable than the first material.

In accordance with a third aspect of the present invention, a vane carrier assembly is provided for supporting vanes within a main engine casing of a gas turbine engine. The vane carrier assembly comprises a vane support assembly, and a control ring loosely coupled, axially supported and radially free in the illustrated embodiment, to the main engine casing such that the main engine casing is capable of moving radially relative to the control ring. The vane support assembly is coupled to the control ring.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

Figure 1:
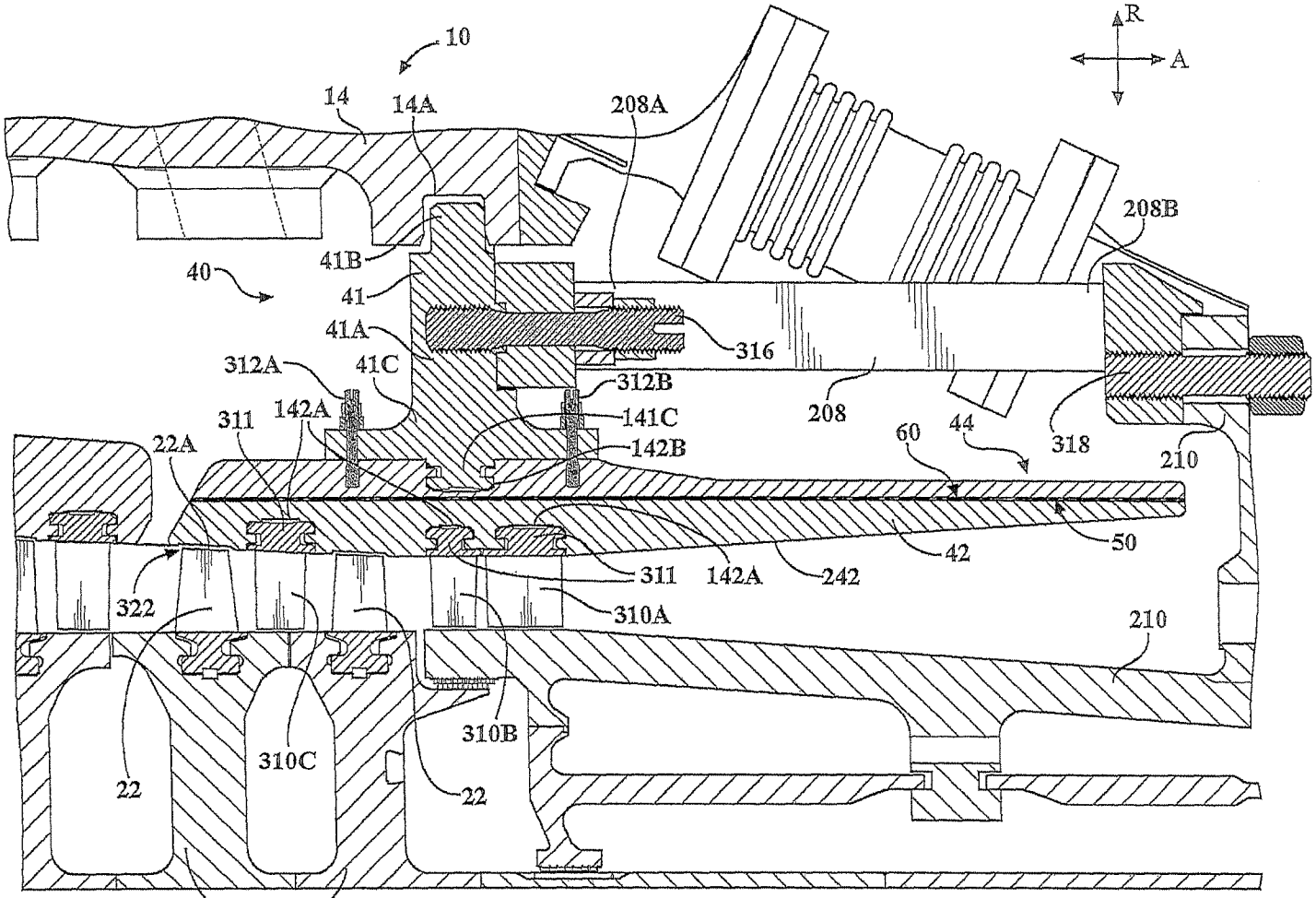
FIG. 1 is a cross-sectional view of a vane carrier assembly constructed in accordance with a first embodiment of the present invention.

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

A gas turbine engine is provided comprising a compressor 10, a combustor (not shown) and a gas turbine (not shown). The gas turbine engine further comprises an outer casing 14, which defines an outer section for each of the compressor 10, the combustor and the gas turbine.

The compressor 10 comprises a plurality of rotor discs 20, which form part of a main engine rotor extending through the compressor 10, the combustor and the gas turbine. Each rotor disc 20 supports a row of rotating blades 22, which function to compress ambient air, which compressed air is provided to the combustor. The rows of blades 22 alternate with rows of stationary vanes. The vanes are mounted to the outer casing 14 via one or more vane carrier assemblies.

Compressor efficiency depends on tip clearance between the compressor rotor blades 22 and an inner surface of the one or more vane carrier assemblies. During operation of the gas turbine engine, fluid leakage through the clearance 322 between tips 22A of the rotor blades 22 and the inner surface of the one or more vane carrier assemblies contributes to system losses, decreasing the operational efficiency of the gas turbine engine. Hence, it is desirable to keep the clearance 322 as small as possible. However, it is necessary to maintain a clearance 322 between the rotating and stationary components during engine operation to prevent contact, such as rubbing, between the rotating and stationary components, which can lead to component damage, performance degradation, and extended downtime.

Figure 2:
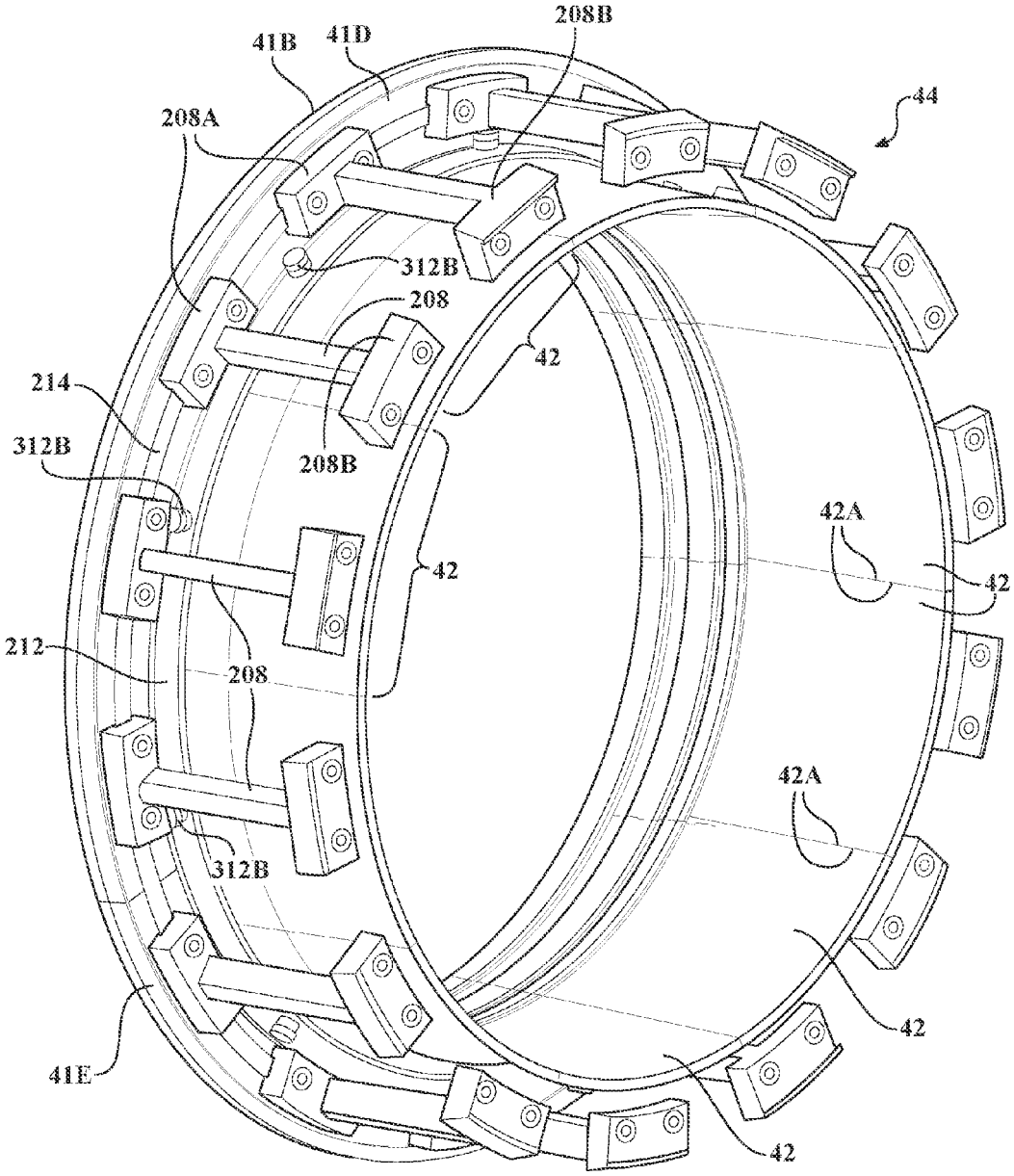
FIG. 2 is a perspective view of the vane carrier assembly of FIG. 1.
Figure 3:
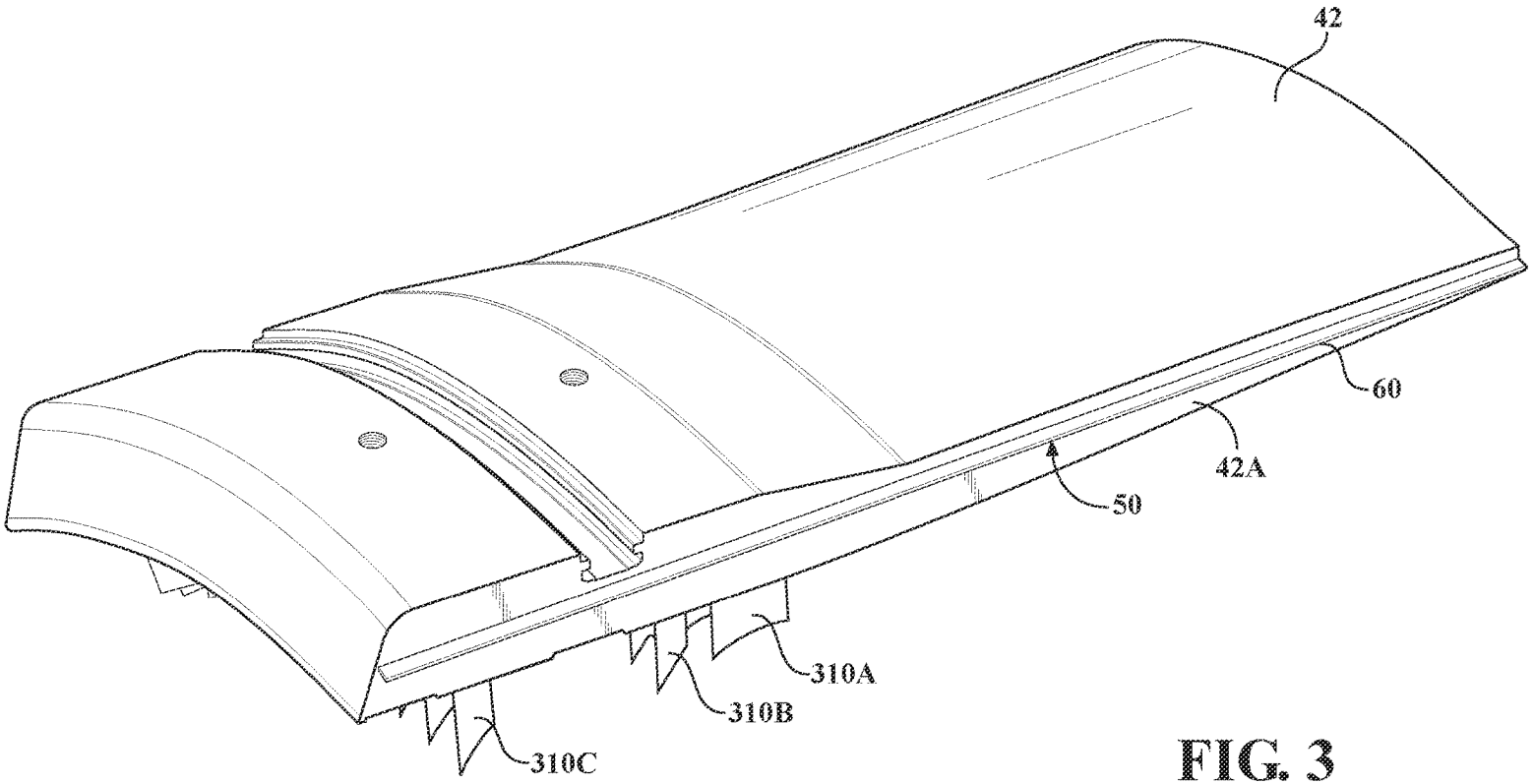
FIG. 3 is a perspective view of a vane support panel according to the present invention.

In accordance with a first embodiment of the present invention, a vane carrier assembly 40 is provided for supporting vanes 310A-310C within the engine outer casing 14, see FIGS. 1-2. The vane carrier assembly 40 comprises an annular control ring 41 and a plurality of vane support panels 42 coupled to the control ring 41. The control ring 41 comprises a main body 41A, a radial outer flange 41B and a radial inner coupling member 41C. The flange 41B is loosely received in an annular recess 14A provided in the engine casing 14. In accordance with the present invention, the control ring 41 is formed from a material having a coefficient of thermal expansion lower than that of the outer casing 14 and the main engine rotor. For example, the outer casing 14 may be formed from a conventional steel alloy such as 2.25 Cr—Mo steel, the components of the main engine rotor may be formed from a conventional steel alloy, such as a NiCrMo alloy, while the control ring 41 may be formed from a material, such as one of INCOLOY® Alloy 909 (a nickel-iron-cobalt alloy), INCOLOY® Alloy 939 (a nickel based alloy), or NILO® Alloy K (a nickel-iron-cobalt controlled-expansion alloy), having a low thermal coefficient of expansion. During gas turbine engine startup, steady-state operation and cool-down, the outer casing 14 expands and contracts radially a greater amount than the control ring 41. For example, during engine startup, the outer casing 14 expands radially a greater amount than the control ring. However, because the control ring flange 41B is loosely received in the annular recess 14A of the engine casing 14, i.e., the flange 41B is axially supported and radially free in the annular recess 14A in the illustrated embodiment, the engine casing 14 is capable of moving radially relative to the flange 41B of the control ring 41 during engine startup, steady state operation and cool down without causing substantial radial movement of the control ring 41. Hence, thermally induced radial movement of the engine casing 14 has little influence on the radial location/position of the control ring 41, i.e., the control ring 41 isn't caused to move a significant amount by the engine casing 14 in the radial direction during engine startup, steady state operation or cool down. The structure 14B defining the annular recess 14A functions to limit movement of the control ring flange 41B and hence the control ring 41 in an axial direction, designed by arrow A in FIG. 1. The radial direction is designated by arrow R in FIG. 1.

In the embodiment illustrated in FIG. 2, ten substantially identical vane support panels 42 are provided. However, the number of panels 42 may be less than ten or greater than 10. The plurality of vane support panels 42 are preferably formed in arcs, such that each may extend circumferentially through an angle falling within a range of from about 30 to about 60 degrees. The vane support panels 42 are assembled to define an annular vane support assembly 44. In the illustrated embodiment, first, second and third rows of first, second and third vanes 310A, 310B and 310C, respectively, are coupled to the panels 42 defining the vane support assembly 44, see FIG. 1. The vanes 310A-310C are coupled to the panels 42 via a sliding dovetail or firtree joint such that an extending member 311 of each vane 310A-310C is received in a corresponding groove 142A provided in a corresponding panel 42, see FIG. 1.

The vane support panels 42 are sized, shaped and assembled such that when they are at ambient temperature, e.g., from about 65 degrees to about 85 degrees, and an engine metal operating temperature, e.g., from about 750 degrees to about 850 degrees, edges 42A of adjacent vane support panels 42 never contact one another. Hence, as the panels 42 increase from ambient temperature to steady state operating temperature during startup and steady state operation of the gas turbine engine, the panel edges 42A do not engage one another. Because the panel edges 42A do not contact one another, the panels 42 are free to expand circumferentially as they increase in temperature. Since the panels 42 are free to expand circumferentially, they expand very little in a radial direction as they increase in temperature. As the panels 42 expand or move zero or very little in a radial direction, the panels 42 cause little or no radial movement of the vanes 310A-310C during start up, steady-state operation or cool down of the gas turbine engine.

A seal arrangement 50 is associated with the vane support panels 42 to prevent compressed gases from passing between adjacent edges 42A of the panels 42. In the illustrated embodiment, a seal 60, such as a conventional feather seal, extends axially along at least one axially extending side edge 42A of each panel 42, see FIGS. 1 and 4. A seal 60 on one panel 42 extends across a gap between the one panel 42 and an adjacent panel 42 and is received in a groove of the adjacent panel 42 so as to prevent gases from passing through the gap between the edges 42A during operation of the engine. The seals 60 do not prevent circumferential movement/expansion of the vane support panels 42. It is also contemplated that a seal extending radially on at least one side edge 42A of a panel 42 may be provided to prevent axially moving gases from moving through the gap between adjacent panels 42.

The vane support panels 42 defining the annular vane support assembly 44 are coupled to the control ring 41 via a sliding dovetail joint or firtree joint. The control ring 41 may be defined by two 180 degree control ring segments 41D and 41E, see FIG. 2. Prior to installation of the two control ring segments 41D and 41E into the engine casing 14, panels 42, e.g., five panels 42 in the illustrated embodiment, may be slidingly joined or connected to each control ring segment 41D and 41E. In the illustrated embodiment, an extending member or male portion 141C of the control ring radial inner coupling member 41C is received in a corresponding groove or female portion 142B provided in each panel 42. Once all panels 42 are coupled to the control ring segments 41D and 41E, the control ring segments 41D and 41E may be installed within the engine casing 14. The vanes 310A-310C are preferably coupled to the vane support panels 42 before the panels 42 are coupled to the control ring segments 41D and 41E. Bolts 312A and 312B extending through the control ring radial inner coupling member 41C into the vane support panels 42 are provided for securing the vane support panels 42 to the control ring 41. In the illustrated embodiment, a first bolt 312A and a second bolt 312B are centered on a corresponding panel 42 and are generally aligned in an axial direction.

In conventional gas turbine engine compressors, typically all of the components of the engine casing, one or more vane carrier assemblies and the main engine rotor are made from a steel alloy material or other material having a high coefficient of thermal expansion. Further, the one or more vane carrier assemblies have a relatively low mass as compared to the main engine rotor. Because the one or more vane carrier assemblies and the main engine rotor are made from a material having a high coefficient of thermal expansion and the one or more vane carrier assemblies have a relatively low mass as compared to the rotor, the one or more vane carrier assemblies respond (through expansion or contraction) more quickly to a change in temperature than the rotor. Hence, the inner surfaces of the one or more vane carrier assemblies may move a radial distance at a greater rate than the rotor during engine start up and cool down. When the engine is stopped, the rotor, because of its large mass, cools down at a much slower rate than the vane carrier assemblies. Hence, once the engine is restarted after being stopped briefly following continuous engine operation, the rotor may be at an elevated temperature, while the vane carrier assemblies are cool. When the engine is restarted, the blade tips expand radially very quickly due to centrifugal forces before the vane carrier assemblies fully expand radially away from the blade tips. The clearance between the vane carrier assemblies and the blade tips must be sufficient to prevent contact when the rotor is at an elevated temperature and, hence, in a radially outwardly expanded condition, the blade tips are radially expanded due to centrifugal forces, and the vane carrier assemblies have not yet expanded radially away from the blade tips. So as to prevent contact between the blade tips and the vane carrier assemblies during an engine restart with the rotor hot, the initial build or cold clearance must be designed sufficiently large to prevent contact between the blade tips and the vane carrier assemblies.

As noted above, in the present invention, the control ring 41 is formed from a material having a coefficient of thermal expansion lower than that of the outer casing 14 and the main engine rotor. Further, the control ring flange 41B is loosely received in the annular recess 14A provided in the engine casing 14. Because the control ring flange 41B is loosely received in the annular recess 14A of the engine casing 14, the engine casing 14 is capable of moving radially relative to the flange 41B of the control ring 41 during engine startup, steady state operation and cool down without causing substantial radial movement of the control ring 41. Further, because the panel edges 42A do not engage one another as the panels 42 expand when heated during engine start up and steady-state operation, the panels 42 expand very little in a radial direction. It is noted that the control ring 41 may expand or contract radially a small amount when its temperature changes, causing a small amount of radial movement of the panels 42. Accordingly, the control ring 41 and the panels 42 move radially very little during engine startup, steady-state operation and cool down. Hence, the inner surfaces 242 of the panels 42 move very little radially relative to initial position of the blade tips 22A. Accordingly, it is believed that the clearance 322 between the inner surfaces 242 of the vane support panels 42 and the blade tips 22A varies by a smaller amount during engine startup, steady state operation and cool down in the present invention as compared to prior art gas turbine engines.

In the illustrated embodiment, a plurality of axially extending support beams 208 are coupled at first ends 208A to the control ring 41 via bolts 316 (shown in FIG. 1 but not shown in FIG. 2). An annular main engine rotor cover 210 (shown in FIG. 1 but not shown in FIG. 2) is coupled via bolts 318 to second ends 208B of the support beams 208. Because the control ring 41 does not move radially or moves radially very little within the engine casing 14, radial movement of the annular cover 210 is reduced making its position more stable within the gas turbine engine.

In the illustrated embodiment, the vane carrier assembly 40 supports the last three rows of vanes 310A-310C of the compressor. It is contemplated that a vane carrier assembly constructed in accordance with the present invention could be used to support any row of vanes in the compressor or in the turbine where thermal response poses a performance debit.

It is contemplated that the vane support panels may be made from a material having a low coefficient of thermal expansion. However, typically such materials are more expensive than materials having higher coefficients of thermal expansion. Because the vane support panels 42 are sized, shaped and assembled so as to expand mainly in the circumferential direction and very little in the radial direction, and the panels 42 are relatively thin in the radial direction, it may be desirable to form the panels 42 from a material having a higher coefficient of thermal expansion as compared to the material from which the control ring 41 is formed so as to reduce costs. Accordingly, the amount of costly, low coefficient of thermal expansion material necessary to better control the clearance 322 between the blade tips 22A and the inner surfaces 242 of the vane support panels 42 is reduced.

It is noted that the control ring 41 of the vane carrier assembly in FIG. 1 has a radial dimension which is greater than an axial dimension.

Figure 4:
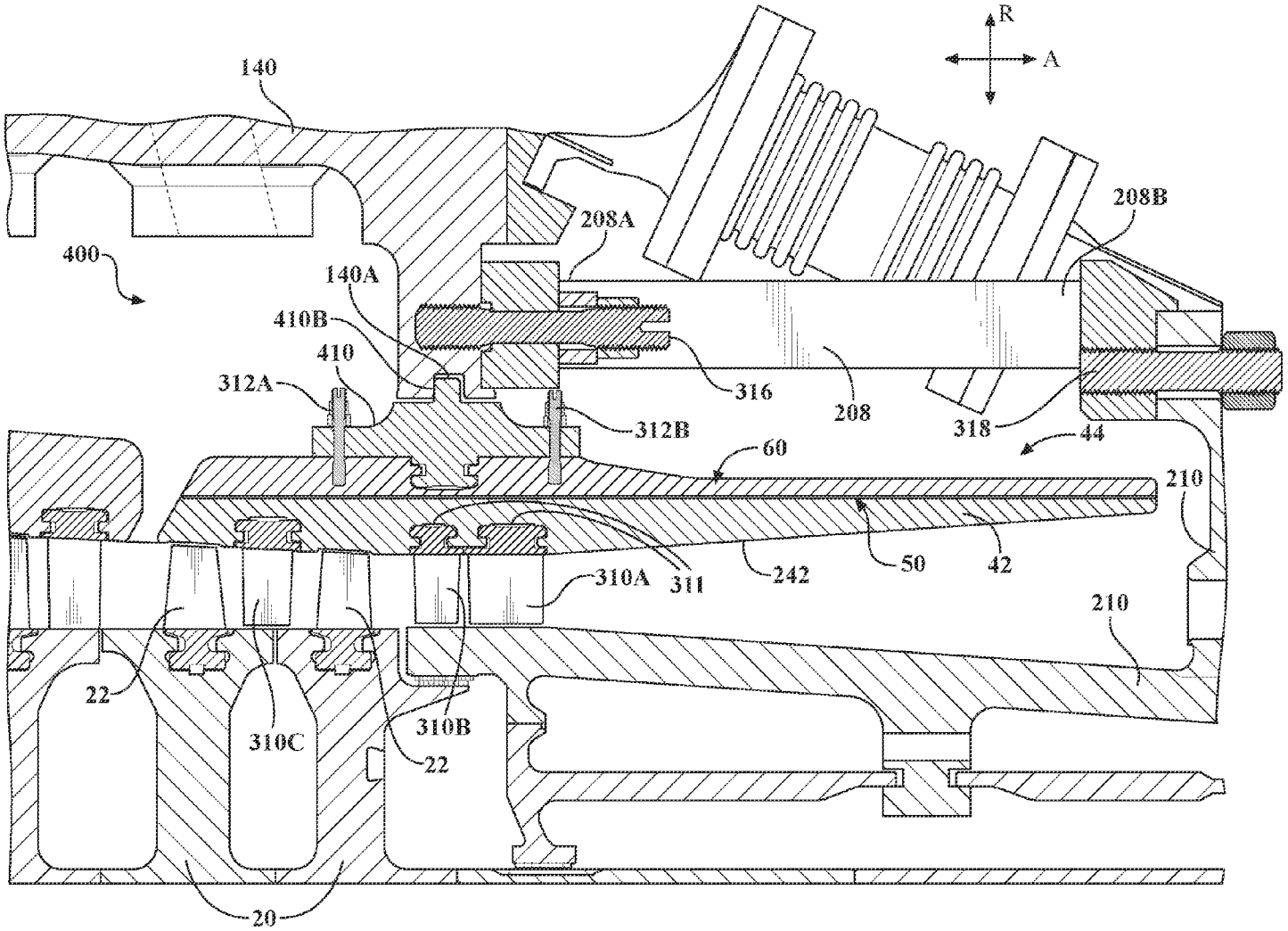
FIG. 4 is a cross-sectional view of a vane carrier assembly constructed in accordance with a second embodiment of the present invention.

A vane carrier assembly 400 constructed in accordance with a second embodiment of the present invention is illustrated in FIG. 4, where elements in the assembly 400 similar to those used in the assembly 40 illustrated in FIG. 1 are referenced by the same numerals as used in FIG. 1. In this embodiment, the control ring 410 has an axial dimension which is greater than its radial dimension. The control ring 410 is smaller than the control ring 41 in the FIG. 1 embodiment; hence, less low coefficient of thermal expansion material is required to form the control ring 410 of the FIG. 4 embodiment as compared to the control ring 41 of the FIG. 1 embodiment. The control ring 410 includes a flange 410B that is loosely received in an annular recess 140A provided in the engine casing 140. Because the control ring flange 410B is loosely received in the annular recess 140A of the engine casing 140, the engine casing 140 is capable of moving radially relative to the flange 410B of the control ring 410 during engine startup, steady state operation and cool down without causing substantial radial movement of the control ring 410.

Figure 5:
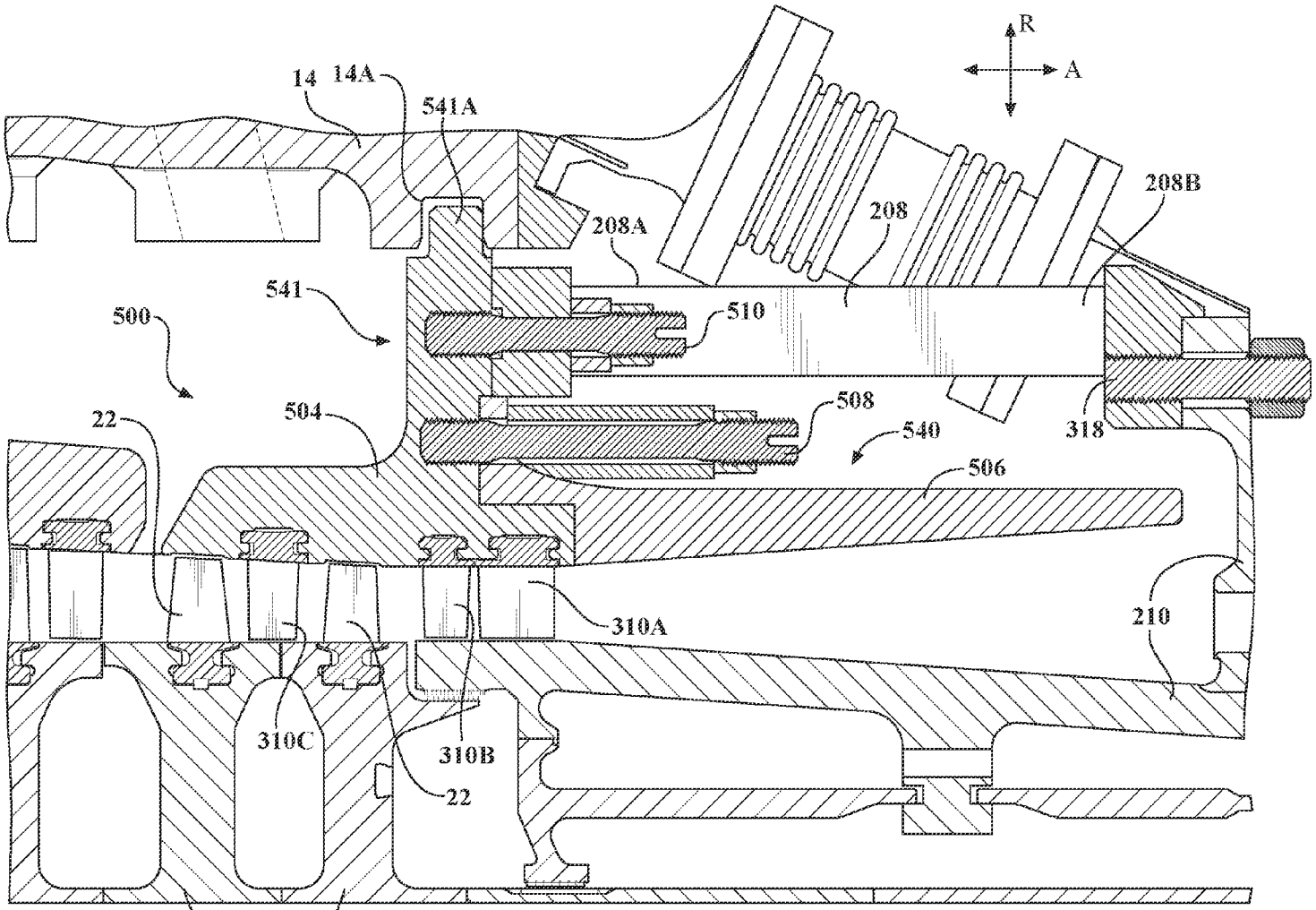
FIG. 5 is a cross-sectional view of a vane carrier assembly constructed in accordance with a third embodiment of the present invention.

A vane carrier assembly 500 constructed in accordance with a third embodiment of the present invention is illustrated in FIG. 5, where elements in the assembly 500 similar to those used in the assembly 40 illustrated in FIG. 1 are referenced by the same numerals as used in FIG. 1. In this embodiment, each of the vane support panels 540 includes a first section 504 and a second section 506. First, second and third rows of first, second and third vanes 310A-310C, respectively, are coupled to the vane support panel first sections 504, see FIG. 5. The first sections 504 are formed integral with a control ring 541 from a material, which preferably comprises a low coefficient of thermal expansion, such as one of INCOLOY® Alloy 909 (a nickel-iron-cobalt alloy), INCOLOY® Alloy 939 (a nickel based alloy), or NILO® Alloy K (a nickel-iron-cobalt controlled-expansion alloy). The control ring 541 includes a flange 541A that is loosely received in an annular recess 14A provided in the engine casing 14. Because the control ring flange 541A is loosely received in the annular recess 14A of the engine casing 14, the engine casing 14 is capable of moving radially relative to the flange 541A of the control ring 541 during engine startup, steady state operation and cool down without causing substantial radial movement of the control ring 510. The second section 506 of each vane support panel 540 is coupled to a corresponding first section 504 via one or more bolts 508 in the illustrated embodiment. The vane support panel second sections 506 may be formed from a material having a higher coefficient of thermal expansion than the material used to form the integral control ring 510 and vane support panel first sections 504 so as to reduce costs.

Figure 6:
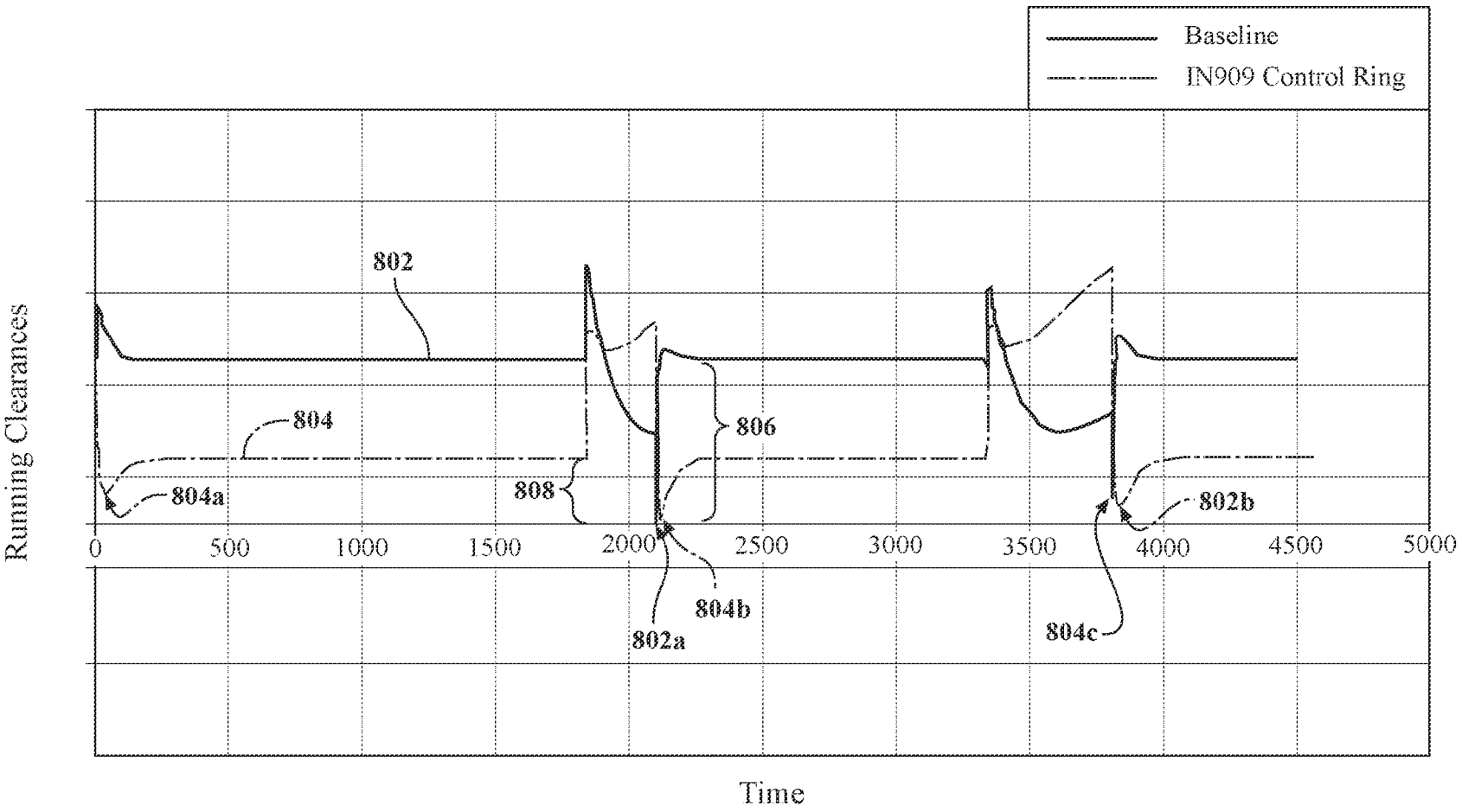
FIG. 6 are plots of measured clearances between blade tips and inner surfaces of vane support panels as a function of time for a conventional vane carrier assembly, and a vane carrier assembly constructed in accordance with the present invention.

Referring now to FIG. 6, running tip clearances (i.e., units of distance along the Y axis) between blade tips and inner surfaces of vane support panels as a function of time (i.e., units of time along the X axis) for a conventional vane carrier assembly, corresponding to plot 802, and a vane carrier assembly constructed in accordance with the embodiment illustrated in FIG. 1, corresponding to plot 804 have been compared. Zero on the Y axis (i.e., labeled as "Running Clearances") implies that the clearance is zero, i.e., the blade tips and vane support panel inner surfaces are just touching. Clearance values above 0 on the Y axis are positive and correspond to an actual spacing between the blade tips and the inner surfaces of the vane support panels and clearance values below 0 on the Y axis are negative and correspond to engagement of the blade tips with the inner surfaces of the vane support panels. FIG. 6 shows three different turbine operating cycles, a cold startup (from about 0 to about 1800 time units), a restart after a brief slowdown following continuous operation at steady state temperatures (from about 1800 to about 3800 time units) and a cool down (after about 3800 time units).

When the conventional gas turbine is initially started, see plot 802, the blades expand outwardly in the radial direction very quickly to close the clearance. Soon thereafter, the vane carrier assembly expands radially outerwardly as it increases in temperature to increase the clearance. From about 50 time units to about 150 time units, the rotor starts to expand radially outerwardly as it increases in temperature to close the clearance. Steady state operation occurs from about 150 time units to about 1800 time units. At about 1800 time units, the engine trips, i.e., slows down. Because the blades are rotating slowly, the blade tips moved radially away from the vane carrier assembly, see the spike in the clearance, which occurs between about 1800-1850 time units. From about 1850 time units to about 1900 time units, the vane carrier assembly cools causing the clearance to reduce. The vane carrier assembly cools more rapidly than the rotor so there is initially a faster close down rate, followed by a slower close down rate. At about 2100 time units, the engine is restarted. Because the rotor is still at an elevated temperature, i.e., still radially expanded, the vane carrier assembly is cool and has not yet moved radially away from the blades and the blades quickly expand due to centrifugal forces, the clearance is nearly zero, see point 802A. Points 802A and 802B are minimum tip clearances, also called "pinch points," for the conventional gas turbine engine. The "build" or "cold" clearance is designed to equal the difference between the steady state clearance and the pinch point 802A closest to zero, see Delta 806. The difference between these two values, i.e., Delta 806, is the desired build clearance to ensure the engine will not rub in operation.

When the gas turbine including the vane carrier assembly of the first embodiment of the present invention is initially started, the blades expand outwardly in the radial direction very quickly from about 0 time units to about 25 time units, see plot 804. From about 25 time units to about 150 time units, the control ring and the rotor expand radially outerwardly as they increases in temperature causing the clearance to increase. Steady state operation occurs from about 150 time units to about 1840 time units. At about 1840 time units, the engine trips, i.e., slows down. Because the blades are rotating slowly, the blade tips moved radially away from the vane carrier assembly, see the spike in the clearance at about 1840 time units. The control ring cools from about 1840 time units to about 1900 time units causing the vane support assembly to move toward the blade tips. Thereafter, the rotor begins to cool slightly moving the blade tips away from the vane support assembly. At about 2100 time units, the engine is restarted. Because the rotor is still at an elevated temperature, i.e., still radially expanded and the blades quickly expand due to centrifugal forces, the clearance is nearly zero, see point 804B. Points 804A, 804B and 802C are minimum tip clearances or "pinch points" for the gas turbine engine including the first embodiment design, with pinch point 804B being the one closest to zero. The "build" or "cold" clearance is designed to equal the difference between the steady state clearance and the pinch point having the lowest value, which is point 804B, see Delta 808. The difference between these two values, i.e., Delta 808, is the desired build clearance to ensure the engine will not rub in operation.

As is clear from plots 802 and 804, Delta 808 is less than Delta 806. Also, the steady state clearance for the vane carrier assembly of the present invention is less than the steady state clearance for the vane carrier assembly of the conventional engine, thereby increasing the efficiency of the compressor having the vane carrier assembly of the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A vane carrier assembly for supporting vanes within a main engine casing of a gas turbine engine, said vane carrier assembly comprising:

a plurality of vane support panels positioned adjacent to one another so as to define a vane support assembly, said support panels being assembled such that said support panels expand circumferentially to minimize radial expansion of said vane support assembly during operation of the gas turbine engine, said support panels extending over at least one row of blades; and a control ring loosely coupled to the main engine casing, said vane support assembly being coupled to said control ring, wherein said plurality of vane support panels are made from a first material and said control ring is made from a second material, wherein said second material is thermally more stable than said first material.

2. The vane carrier assembly of claim 1, wherein said control ring is supported by the main engine casing such that the main engine casing is capable of moving radially relative to said control ring.

3. The vane carrier assembly of claim 1, wherein said first material has a coefficient of thermal expansion greater than that of said second material.

4. The vane carrier assembly of claim 1, wherein said first material is formed from a steel alloy.

5. The vane carrier assembly of claim 1, wherein said second material is formed from a nickel-iron-cobalt alloy.

6. The vane carrier assembly of claim 1, wherein said control ring has a radial dimension which is greater than an axial dimension.

7. The vane carrier assembly of claim 1, wherein control ring has an axial dimension which is greater than a radial dimension.

8. The vane carrier assembly of claim 1, wherein each of said vane support panels extends generally circumferentially in response to thermal expansion and contraction during operation of said gas turbine engine.

9. The vane carrier assembly of claim 1, wherein said control ring is formed from a low thermal coefficient of expansion material to generally minimize thermal expansion and contraction of said control ring in a radial direction.

10. The vane carrier assembly of claim 1, wherein said control ring and support panels are coupled so as to move radially together.

11. A method of controlling clearance between tips of rotating blades and an inner surface of a vane support assembly within an engine casing of a gas turbine engine, said method comprising:

providing a plurality of vane support panels positioned adjacent to one another to define the vane support assembly, the panels being made of a first material and extending over at least one row of blades;

providing a control ring adapted to be supported by the engine casing for movement relative to the engine casing and made of a second material; and securing said vane support assembly to said control ring, wherein said second material is thermally more stable than said first material.

12. The method of claim 11, wherein said first material has a coefficient of thermal expansion greater than that of said second material.

13. A vane carrier assembly for supporting vanes within a main engine casing of a gas turbine engine, said vane carrier assembly comprising:

a vane support assembly comprising a plurality of vane support panels positioned adjacent to one another, each of said support panels comprising a first section and a second section, said panel second sections being formed from a first material and said panel first sections and a control ring being formed from a second material, said first material having a coefficient of thermal expansion greater than that of said second material; and said control ring loosely coupled to the main engine casing such that the main engine casing is capable of moving radially relative to said control ring, said vane support assembly being coupled to said control ring.

14. The vane carrier assembly of claim 13, wherein said first material is formed from a steel alloy.

15. The vane carrier assembly of claim 13, wherein said second material is formed from a nickel-iron-cobalt alloy.

16. The vane carrier assembly of claim 13, wherein said control ring and support panels are coupled so as to move radially together.

* * * * *